United States Patent [19]

Roccon et al.

[11] Patent Number: 5,072,492

[45] Date of Patent: Dec. 17, 1991

[54] APPARATUS FOR DEPOSITING CARD SLIVERS IN ROTATING CANS

[75] Inventors: Roberto Roccon, Bürglen; Martin Schwager, Winterthur, both of Switzerland

[73] Assignee: Maschinenfabrik Rieter AG, Winterthur, Switzerland

[21] Appl. No.: 515,587

[22] Filed: Apr. 27, 1990

[30] Foreign Application Priority Data

Apr. 27, 1989 [DE] Fed. Rep. of Germany ..... 3913998

[51] Int. Cl.[5] ..... B65H 54/80

[52] U.S. Cl. ..... 19/159 R

[58] Field of Search ..... 19/159 R, 159 A

[56] References Cited

U.S. PATENT DOCUMENTS

| | | | |
|---|---|---|---|
| 3,736,625 | 6/1973 | Johns | 19/159 R |
| 4,074,394 | 2/1978 | Kunig et al. | 19/159 R |
| 4,545,093 | 10/1985 | Jagst | 19/159 R |
| 4,694,540 | 9/1987 | Rosink | 19/159 R |
| 4,726,097 | 2/1988 | Zimmerman et al. | 19/159 R |

FOREIGN PATENT DOCUMENTS

| | | | |
|---|---|---|---|
| 0175072 | 7/1986 | European Pat. Off. . | |
| 0338277 | 3/1989 | European Pat. Off. . | |
| 2644003 | 9/1976 | Fed. Rep. of Germany . | |
| 2611774 | 10/1976 | Fed. Rep. of Germany . | |
| 2643349 | 4/1977 | Fed. Rep. of Germany . | |
| 1408117 | 6/1965 | France . | |
| 357007 | 10/1961 | Switzerland . | |
| 471739 | 6/1969 | Switzerland . | |
| 473046 | 7/1969 | Switzerland . | |
| 2084199 | 4/1982 | United Kingdom | 19/159 R |
| 1528688 | 10/1988 | United Kingdom . | |

*Primary Examiner*—Werner H. Schroeder
*Assistant Examiner*—John J. Calvert
*Attorney, Agent, or Firm*—Burns, Doane, Swecker & Mathis

[57] ABSTRACT

A can filling apparatus receives a band of carded fibers from a carding machine and deposits it in a rotating storage can. The apparatus includes a head part arranged above a rotatable can and having a rotary plate driveable to execute a rotational movement. Two calender rolls journalled for rotation on at least substantially horizontal axes on the rotary plate deposit the fiber band in continuous cycloidal loops into the can. At least one of the calender rolls is driveable by a friction wheel which is rotatably journalled on the rotary plate and runs around a fixed ring surface of the head part. An imaginary axis about which the friction wheel turns is arranged fixed in space relative to the rotary plate and the friction wheel has a conical surface which rolls off on a complementary conical ring surface of a window ring. The friction wheel can be adjusted or biased in the direction of the imaginary axis into engagement with the window ring and drives the calender roller associated with the friction wheel directly or via a shaft representing the rotational axle of the calender roller, optionally via a conical wheel arranged between the friction wheel and the shaft or between the friction wheel and the calender roller.

17 Claims, 4 Drawing Sheets

FIG. 1
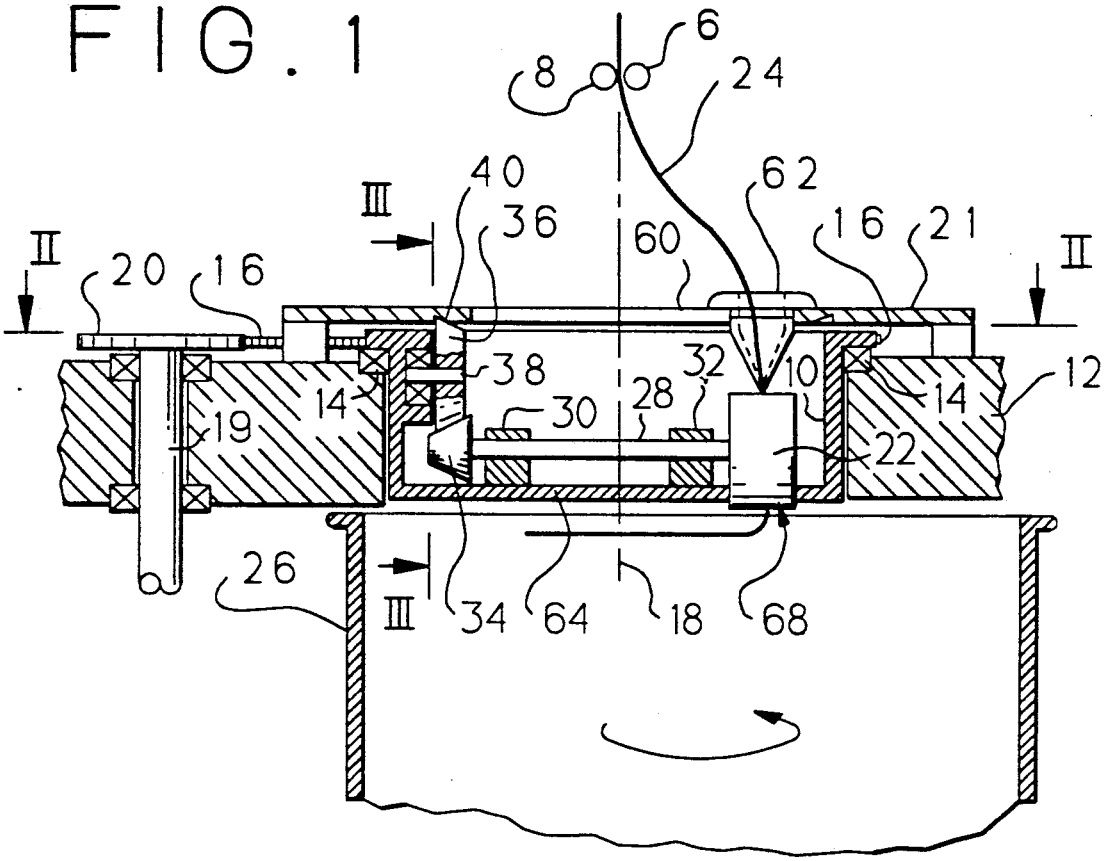
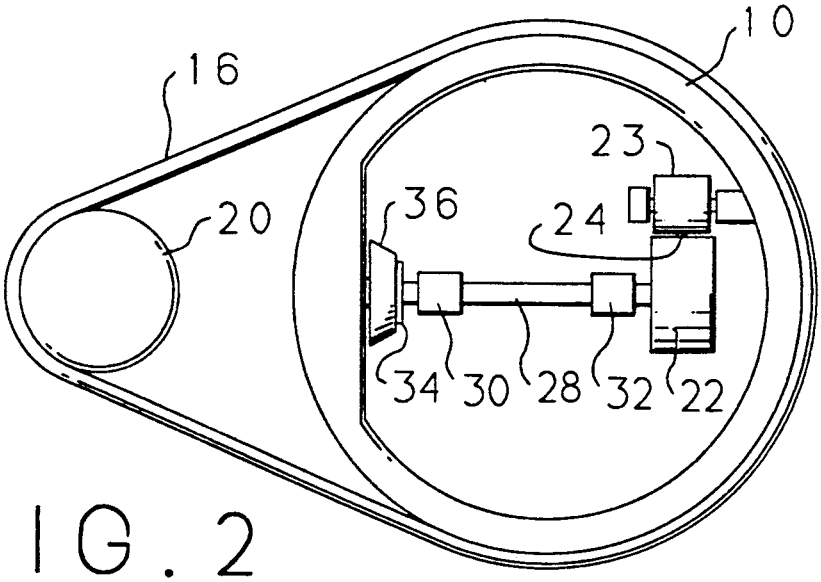
FIG. 2

APPARATUS FOR DEPOSITING CARD SLIVERS IN ROTATING CANS

FIELD OF THE INVENTION

This invention relates to apparatus for depositing a band of fibers, such as a card sliver of cotton fibers, into a rotating receptacle such as a sliver can. It is concerned particularly with systems for rotating about their own axes the calender rolls which deliver the fiber band into the can at a controlled linear speed.

BACKGROUND

Can filling apparatus generally comprises means for rotating the can beneath a head part on which there is a driven plate rotatable about a vertical axis. The rotary plate carries a pair of calender rolls rotatable about generally horizontal axes and arranged to grip the sliver and feed it into the can at a controlled speed, depositing it in continuous cycloidal loops in the can.

Can filling apparatus of the general type with which the present invention is concerned is disclosed in EP-OS 175 072, laid-open on Mar. 26, 1986 and corresponding to U.S. Pat. No. 4,694,540. However, the apparatus disclosed is of complicated and expensive design.

A somewhat simplified form of can filling apparatus of this general kind is also known from DE-OS 33 18 944, laid-open on Nov. 29, 1984 and corresponding to U.S. Pat. No. 4,545,093. The design of this device is less complex. However, the design that has been selected leads to an undesired loading of the fiber band so that band breakages can occur, particularly when the machine has been in use for a long period of time and wear has led to undesired play in the individual elements.

In the design of DE-OS 33 18 944 the axle which carries the friction wheel is pivotably (i.e. hingedly) supported at its end opposite to the friction wheel and a compression coil spring arranged beneath the axle attempts to pivot the axle upwardly and thereby hold the friction wheel in engagement with the horizontal ring surface of the head part on which it rolls in operation. Wear of the friction wheel and tolerances in the design are compensated for by this spring. The friction wheel and the one calender roller form a hollow unit which is rotatably journalled on a pivotable axle. This unit also contains a gear wheel which meshes with a further gear wheel which drives a second calender roller. In this way the axle of rotation of the second calender roller is fixedly arranged on the rotary plate. With this design the guidance of the pivot axle causes certain problems which in operation lead to the mutual spacing between the two calender rollers no longer remaining constant, in particular when a certain amount of wear has occurred. Thus the clamping of the band or sliver between the two calender rollers leaves something to be desired.

Moreover, deflection movements of the pivotally journalled axle about its pivot axis also lead to a change of the clamping force and, via the intermeshing gear wheels also to a variation of the speed of rotation of the two calender rollers, which is also undesirable. Furthermore, the layout of the friction wheel with a horizontally extending surface is unfavorable because the friction wheel itself is deformed by this design as the circumferential speed of the radially inner edge of the friction wheel must be lower than the circumferential speed of the radially outer edge of the friction wheel, with the expression "radial" being understood here in relation to the axis of rotation of the rotary plate. The continuous deformation of the friction wheel as a result of this design necessarily leads to premature wear of the friction wheel which increases the already mentioned difficulties in the area of the calender rollers.

With such a complicated design a constant loading of the fiber band cannot always be achieved in the clamping region between the calender rollers, and there is a danger of band breakages, particularly after the wear which occurs in long term operations.

SUMMARY OF THE INVENTION

In accordance with one embodiment of the present invention, the imaginary axis about which a friction wheel turns is arranged fixed in space relative to the rotary plate and the friction wheel has a conical surface which rolls off on a complementary conical ring surface of a window ring. The friction wheel can be adjusted or biased in the direction of the imaginary axis into engagement with the window ring and drives the calender roller associated with the friction wheel directly or via a shaft representing the rotational axle of the calender roller. Optionally, the calender roll may be driven via a conical wheel arranged between the friction wheel and the shaft or between the friction wheel and the calender roller.

By using a friction wheel with a conical surface it is possible to do away with pivotal guidance of the axle which carries the friction wheel. In place of this the axis of rotation of the friction wheel can be mounted on the rotary plate by means of conventional bearing arrangements so that the imaginary axis of rotation of the friction wheel is fixedly arranged with respect to the rotary plate. In this manner no changing clamping forces arise so that the need to pivotally guide the axle of rotation of the friction wheel is avoided.

Reliable engagement between the friction wheel and the ring surface of the head part is achieved by axial bias of the friction wheel which has a conical surface. Furthermore, this conical surface can be so laid out by intentional choice of the cone angle with regard to the dimensions of the individual elements and the selected working speed, that no slip and no deformation of the friction wheel arises, so that no notable wear of the friction wheel can arise even over a long period of time, which likewise leads to constant conditions in the clamping region of the calender rollers.

In a particularly preferred embodiment, the friction wheel has a cylindrical surface in addition to the conical surface, with the cylindrical surface standing in contact with the calender surface and directly driving the latter. This arrangement has a minimum of individual elements, it is very compact, and it enables a very stiff construction of the mountings for the calender roller, so that the working conditions in the clamping region of the calender rollers always remain constant.

As an alternative to this embodiment a conical surface of the friction wheel can enter into contact with a cone wheel arranged at one end face of the calender roller.

In an alternative embodiment, the conical surface of the friction roller can be in driving engagement with a cone wheel which is diametrically oppositely disposed to the calender roller and drives the calender roller via the said shaft.

In order to minimize or avoid undesirable slip, the largest radius of the conical surface of the friction wheel should be arranged further away from the axis of rotation of the rotary plate than the smallest radius of this surface. That is, when arranging a window ring above the rotary plate or the friction wheel, the conical surface of the friction ring on which the friction wheel rolls should diverge upwardly. When using a cone wheel the later should be arranged such that its conical surface complementary to the friction wheel converges in the opposite direction to the conical surface of the friction wheel.

In an alternative form of the invention, the imaginary axis about which the friction wheel turns is arranged fixed in space relative to the rotary plate; and the fixed ring surface is formed on a window ring which is biased in the direction towards the rotary axis of the rotary plate and towards the friction wheel.

This arrangement can be used both with a conical friction wheel and also with a cylindrical friction wheel. The contact of the friction wheel on the window ring is achieved by the spring bias of the friction wheel, with the advantage also being obtained that the axis of rotation of the friction wheel does not have to be pivotally guided (i.e. hingedly guided).

The bias of the window ring towards the friction wheel can be achieved by means of spring elements, for example by means of compression coil springs which press against the surface of the window ring remote from the friction wheel and are braced against the head part. In this way the window ring is biased towards the friction wheel in the manner of the pressure plate of a clutch and, if desired, the window ring can also be brought out of engagement with the friction wheel by the provision of a few levers or actuating means, so that a decoupling of the drive is possible.

It is also possible to support the window ring with play in the direction radial to the axis of rotation of the rotary plate. In this way a type of self-centering of the window ring with the axis of rotation of the rotary plate can be achieved.

With a spring loaded window ring it can be of advantage to provide further auxiliary friction wheels on the rotary plate in order to avoid an undesired swash plate-like movement of the biased window ring.

In all previously described embodiments it is also possible to drive the second calender roller by the friction wheel, and indeed via a drive means which brings about a reversal of the direction of rotation, so that the second calender roller turns in the required manner in the opposite direction to the first named calender roller.

By way of example, when driving the first named calender roller by the friction wheel via a cone wheel, the cone wheel can be in driving engagement with a further cone wheel secured to the axle of rotation of the second calender roller, and can thus also take care of driving the second calender roller.

A further measure which reduces the slippage and which can also be used independently of the other measures lies in the fact that the first named calender roller rotates about an axle which is radially arranged relative to the rotary plate and itself has a conical outer surface, with the tip of this conical outer surface lying on or in the immediate vicinity of the axis of rotation of the rotary plate. The second calender roller then has the same form as the first calender roller, is however oppositely directed to the latter. This embodiment favors the draft free laying down of the fiber band.

Finally, it must be mentioned that in known manner the rotary driving of the drive plate can also take place from a motor which brings about the rotary movement of the can, preferably via a drive belt which engages around a ring wall of the rotary plate.

BRIEF DESCRIPTION OF THE DRAWINGS

The invention will now be explained in more detail with reference to embodiments shown in the drawings, in which:

FIG. 1 is a partly sectioned view of a head part of a can filling apparatus in accordance with the invention, in which only parts important for an explanation of the invention are shown;

FIG. 2 is a view in the direction II—II of the embodiment of FIG. 1;

DETAILED DESCRIPTION OF PREFERRED EMBODIMENTS

Figure 3:
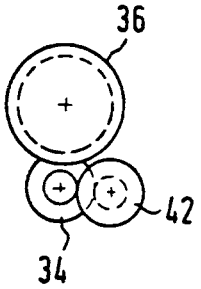
FIG. 3 is a view of a variant of the embodiment of FIG. 1, with the view being shown in accordance with the direction III—III in FIG. 1.

The reference numeral 10 in FIG. 1 shows a pot-like rotary plate which is rotatably journalled in the head part 12 of a can filling apparatus by means of a bearing 14. The rotary plate 10 is driven in operation by a belt 16 to execute a rotary movement about its axis of rotation 18. The belt 16 itself is set in motion by a motor (not shown) via a shaft 19 and a belt pulley 20. The drive belt 16 extends around the drive wheel 20 and also around the upper flange of the pot-like rotary plate 10.

Above the rotary plate there is located a window ring 21 which in this embodiment is fixedly secured to the head part 12.

Within the rotary plate there is located a pair of calender rollers 22 and 23, of which only the one calender roller 22 can be seen in FIG. 1. The calender roller pair serves to lay the card band 24 coming from a guide along the axis of rotation 18 of the rotary plate in known manner in continuous cycloidal loops within a can 26 which is arranged beneath the head part 12 and which is itself driven to execute a rotary movement. The rotary movement of the can is likewise brought about by the shaft 19, the lower end of which drives a turntable via non-illustrated gear wheels so that the turntable which supports the can 26 executes a rotary movement.

The calender roller 22 is rotationally fixedly connected to an axle 28 which is rotationally journalled in two spaced apart bearings 30, 32 of the rotary plate. At the end of the axle 28 opposite to the calender roller 22 there is located a cone wheel 34. Between the cone wheel 34 and the window ring 21 there is provided a friction wheel 36 which has a conical surface and which is rotationally fixedly but axially adjustably mounted on an axle of rotation 38. Axle 38 is rotationally supported in a bearing in the side wall of the pot-like rotary plate 10.

As can be seen the conical surface of the friction wheel meshes, on the one hand, with the corresponding ring surface 40 of the window ring and, on the other hand, with the complementary cone surface of the cone wheel 34. Thus, the rotary movement of the rotary plate causes the friction wheel 36 to execute a roll-off movement on the conical surface 40 of the window ring and thus also leads to a rotary movement of the cone wheel 34 which drives the calender roller 22 via the axle 28. The rotary movement of the calender roller 22 is so selected that the card band 24 is drawn downwardly and then deposited in the mentioned manner into the can.

The second calender roller 23 shown in FIG. 2 lies parallel to the calender roller 22 and forms a clamping position or nip with the latter. The second calender roller is the driven with the same speed of rotation as the cam roller 22 by means of friction. The second calender roller can however also be driven, for example either by intermeshing gear wheels, for example as shown in DE-OS 33 18 944 (the disclosure of which is incorporated herein by reference), or with an arrangement as illustrated in FIG. 3.

As can be seen from FIG. 3 the cone wheel 34 meshes with a further cone wheel 42 which has the same shape as the cone wheel 34 is however directed in the opposite direction. The arrangement is such that the second cone wheel 42 no longer stands in engagement with the friction wheel 36, but rather only with the cone wheel 34, so that it turns in the opposite direction to the cone wheel 34 but with the same speed. The second cone wheel 42 is connected with the further calender roller via a further axle corresponding to the axle 28, with this further axle also be rotatably supported in spaced apart bearings on the rotary plate. In other words the arrangement of the cone wheel 42, with a further axle and of the further calender roller 23 is the same as the arrangement of the cone wheel 34, the axle 28 and the calender roller 22, with the exception that the cone wheel 42 is directed in the opposite direction from the cone wheel 34.

Figure 4:
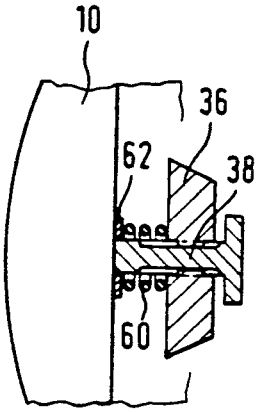
FIG. 4 is an enlarged representation of the friction wheel of FIG. 1 with a bias means.

FIG. 4 shows a section through the friction wheel 36 from which one can see that the friction wheel is rotationally fixedly mounted on a rigid rotatable axle 38 by means of a splined arrangement. The friction wheel 36 is axially displaceable in this embodiment on the axle 38 and is biased in FIG. 4 in the axial direction to the right by means of a compression coil spring 60 which is supported, on the one hand, at the left hand end face of the friction roller 36 and, on the other hand, against a disk-like abutment provided adjacent the left hand end of the axle 38. In operation the friction wheel is continuously pressed to the right by the spring 60, so that the desired contact pressure exists against the conical surface of the window ring 21. The spring compensates for any wear at the friction wheel or at the window ring in that it always generates the desired contact pressure between the friction wheel and the window ring. At the same time the compression spring 60 ensures that adequate contact pressure exists with the cone wheel 34.

Instead of providing an automatic adaptation by means of a coil spring 60 one can also make the friction wheel adjustable, for example by packing spacer disks 64 between the friction wheel 36 on the abutment 62 in order to achieve the respectively desired adjustment relative to the window ring 21. This arrangement can be subsequently adjusted if any wear occurs by inserting more or thicker spacer disks.

Figure 6:
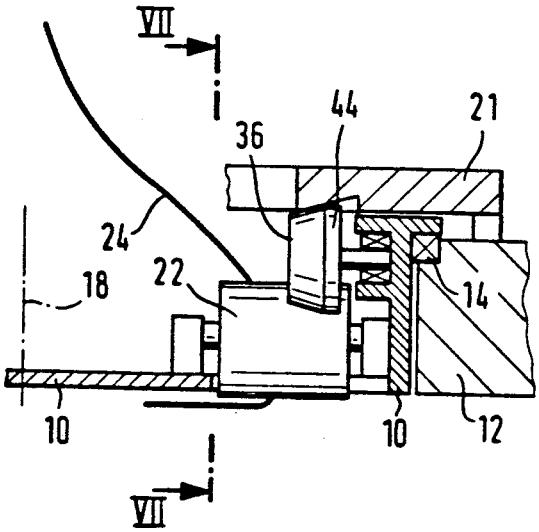
FIG. 6 is a view similar to that of FIG. 1 but of a variant with only the part to the right of the axis of rotation of the rotary plate being shown.
Figure 7:
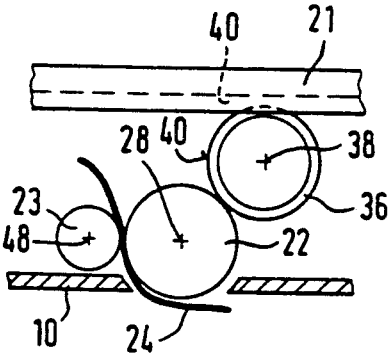
FIG. 7 is a view in the direction VII—VII of the embodiment of FIG. 6.

FIGS. 6 and 7 show a further embodiment which is particularly preferred because it makes do with few components but is nevertheless very effective. With this embodiment parts which correspond to the previous embodiment are characterized with the same reference numerals. In particular attention should be paid here that the friction wheel 36, in addition to the conical surface, also has a cylindrical surface 44 which stands directly in contact with the circumference of the calender roller 22. In this embodiment the second calender roller 23 is driven from the first calender roller 22, being freely rotatably mounted by means of an axle 48. As in another embodiment the geometrical arrangement of the two calender rollers can be as described in the earlier Swiss patent application CH 01 321/88-9, or in the earlier EP application with the publication No. 338 277, claiming priority of CH 01 321/88-9 and laid-open on Oct. 25, 1989, both corresponding to U.S. Pat. No. 4,999,883, the disclosures of both of which are incorporated herein by reference.

Figure 5:
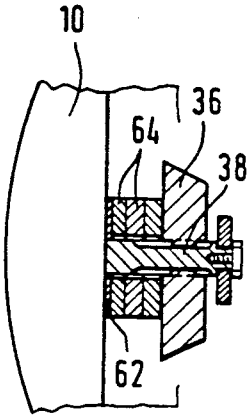
FIG. 5 is a representation similar to that of FIG. 4 with the axial position of the friction wheel being adjustable.
Figure 8:
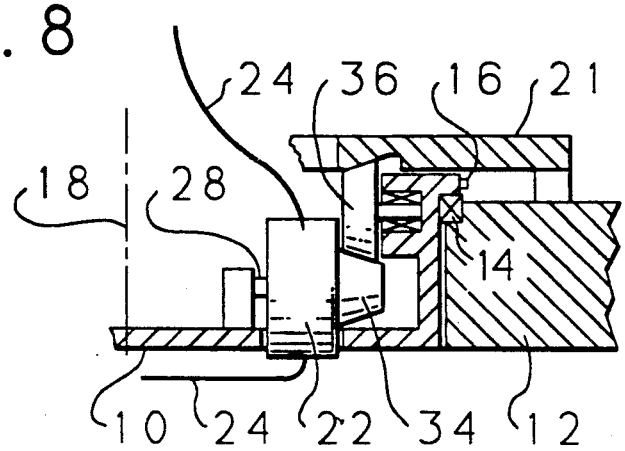
FIG. 8 is a schematic view corresponding to FIG. 6 but of a further embodiment.

A further embodiment can be found in FIG. 8 and here the same components are also characterized by the same reference numerals as in earlier embodiments. In this case the cone wheel 34 is directly mounted at the end face of the calender roller 22 or made in one piece with the latter. The adjustability of the friction wheel 36 is here selected in accordance with the embodiments of FIGS. 4 or 5.

Figure 10:
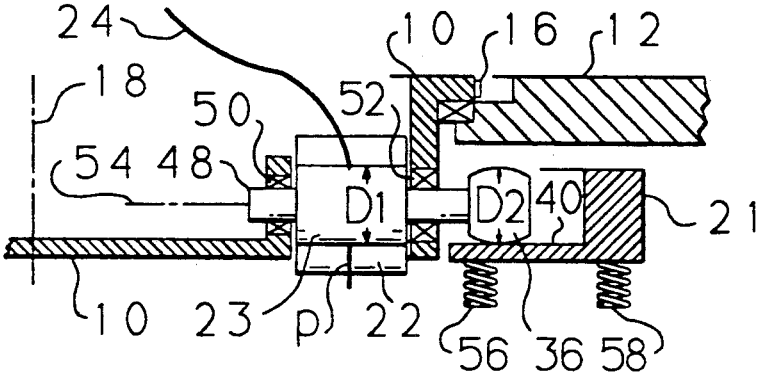
FIG. 10 is a schematic view, likewise in accordance with FIG. 6, of a further embodiment in which only the head part to the right of the axis of rotation of the rotary plate is shown.

FIG. 10 shows a further embodiment which has been somewhat differently conceived than the previously described embodiments in which however, as previously, the same components have been characterized by the same reference numerals. Here the smaller calender roller 23 is mounted on a rotational axle 48 which is journalled in fixed bearings 50 and 52 of the rotary plate, i.e. the imaginary axis of rotation 54 of the calender roller 23 is in this arrangement spatially fixedly arranged relative to the rotary plate. The rotational axis 48 of the calender roller 23 is extended outwardly in the radial direction and carries the friction wheel 36 outside of the rotary plate 10. In contrast to the previous embodiments the friction wheel is here formed as a cylinder wheel, although it could just as easily be a cone wheel.

The cylinder wheel 36 runs on a ring surface 40 of the window ring 21, with the window ring 21 being biased upwardly in FIG. 10 by means of a compression coil spring 56, 58, so that adequate engagements always exists between the friction wheel 36 and the window ring 21. Although only two coil springs 56, 58 are shown in this embodiment it will be understood that several such spring pairs are arranged distributed at regular angular intervals around the axis of rotation 18 of the rotary plate. In this embodiment one also sees that the friction wheel 36 has a diameter D2 which is somewhat smaller than the diameter D1 of the calender roller 23. The diameter ratio of D1/D2 is so selected that no relative speed occurs at point P. In this embodiment the calender roller 23 is the smaller and it drives the large calender roller 22.

Figure 9:
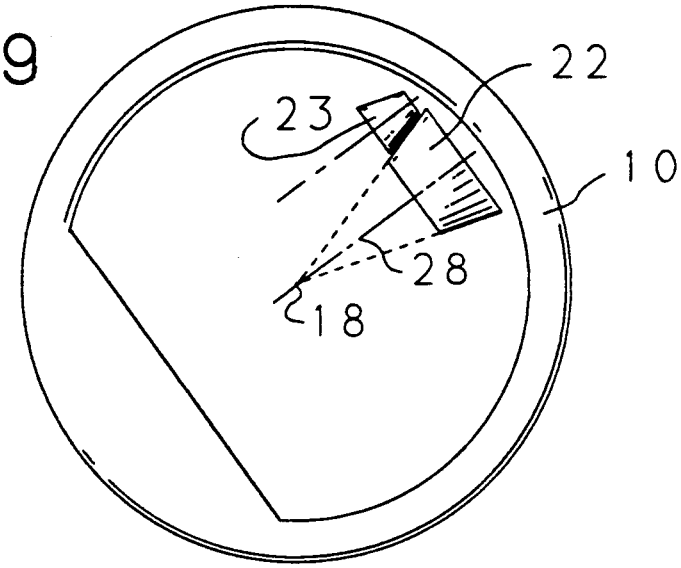
FIG. 9 is a schematic plan view onto a rotary plate from which a particular arrangement of the calender rollers is evident.

FIG. 9 shows a form for the calender roller 22 and the calender roller 23 which meshes with it, with this shape being particularly favorable. The jacket surface of the calender roller 22 is namely a conical surface, with the associated cone being so arranged that its tip lies on the axis of rotation 18 of the rotary plate. The calender roller 23 has the same shape but is however oppositely directed. As a result of this embodiment the axle of rotation 28 of the calender roller 22 is also radially directed relative to the rotary plate 10. The axle 28 is however inclined slightly relative to the axis 18 so that the surface of the calender roller 22 extends horizontally at its lowest position where it lays the card band or sliver into the can. This embodiment is particularly favorable for the draft-free laying down of the band.

In all embodiments with friction wheels with conical surfaces the friction wheel can comprise a metal wheel with a rubber layer at the surface, and of course all other soft-elastic rubber-like substances such as for example polyurethane can be used in place of rubber.

Figure 11:
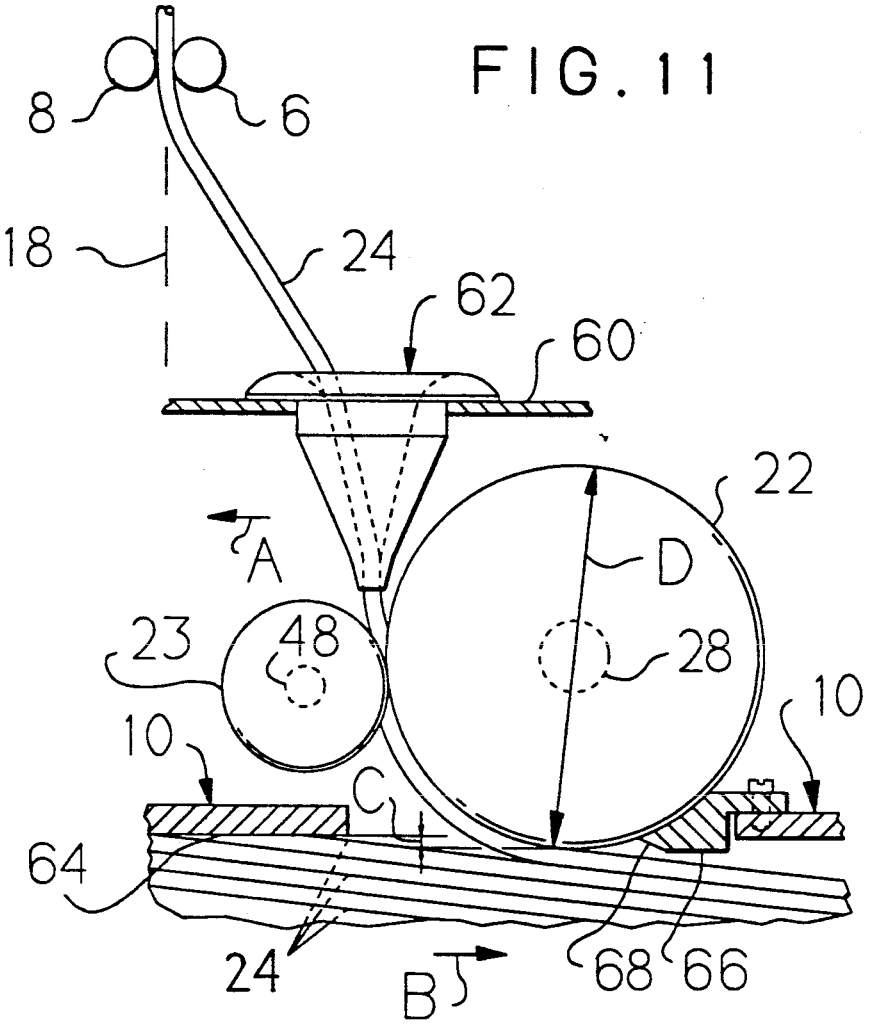
FIG. 11 is a view similar to FIG. 7 but illustrating further details of the specific arrangement of the calender roller 22, with this view also being applicable to the arrangement of the calender roller in other figures.
Figure 12:
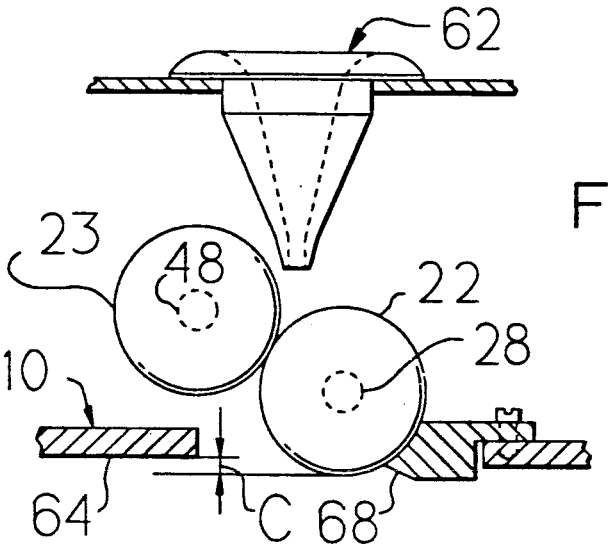
FIG. 12 is a view similar to FIG. 11 but showing a further modified arrangement of the calender rollers 22 and 23.

FIGS. 11 and 12 show two practical arrangements which can be used with all previous embodiments and which are particularly favored. It will be noted that the card band or sliver 24 is first directed through a pair of deflection rollers 6, 8 arranged with the nip between these deflection rollers on the axis of rotation of the rotary plate 10. The rotary plate 10 is provided with a cover plate 60 which rotates with it and the card ban passes through a funnel member 62 arranged on the cover plate 60 just above the calender rolls 22 and 23. The calender roll 22 may also be termed a deposition roller and is responsible for laying or depositing the card band onto the card band already deposited into the can. This takes place directly.

In particular it will be noted that the calender roller 22 has a diameter D which is selected such that the periphery of the calender roller 22 lies for a predetermined position of the shaft 28 an amount C lower relative to the can than the lower side 64 of the rotary plate 10. The fact that the circumference of the calender roller 22 projects by the amount C deeper into the can 26 means that the calender roller 22 lays or deposits the card band directly onto the loops or layers of card sliver which are already present in the can.

The amount C can for example be selected to lie in the range of from one to ten millimeters (i.e., 1 to 10 mm). The size of the amount C depends however on the desired degree of compression of the band which is to be deposited onto the band layers already present in the can and is selected appropriately.

The deposition plate 66 which precedes the calender roller 22 in the direction of movement has the task of compressing the card band which has been laid into the can 26, in combination with the spring loaded plate, which pushes the layers upwardly from the bottom. This spring is not shown in the drawing but lies in known manner at the base of the can.

It will be understood that the circumferential speed of the calender roller 22 is selected such that no relative speed arises between the band 24 to be deposited and the loops that are already present in the can. The can 26 is rotating during this laying process in the direction B (FIG. 11) and the rotary plate 10 in the direction A. The nature of the loop formation in the can when both the can and the rotary plate are turning is cycloidal. A scraper member 68 is provided to avoid fibers from sticking to the calender roller 10. The lower side of this scraper member 68 in fact forms the laying plate as previously mentioned. A further scraper member can be provided to scrape fibers from the mating calender roller 23. This further scraper member can be arranged in the manner shown in European patent application publication number 338 277.

FIG. 12 shows that the two calender rollers 22 and 23 can be executed with substantially the same diameter while nevertheless retaining the feature that the calender roller 22 projects by an amount C below the bottom of the rotary plate 10.

The circumferential surface of the calender roller need not be flat (cylindrical). It could, for example, also be concave or be provided with grooves which run in a generally axial direction.

Finally, it will be noted that the two calender rollers can also be surrounded by recirculating bands which further guide the card band. In other words the recirculating bands can be laid out precisely as shown in FIG. 11 of European application publication number 338 277. Of course further details from this European specification can also be used as appropriate with the arrangement of the present application.

While the invention has been described with reference to the foregoing embodiments, variations and modifications can be made thereto which fall within the scope of the appended claims.

What is claimed is:

1. Can filling apparatus comprising a head part which is arranged in operation above a rotatable can and a rotary plate driveable to execute a rotational movement, with the rotary plate depositing a fiber band in continuous cycloidal loops into the can by means of two calender rolls which are journalled on the rotary plate via at least substantially horizontal axes, wherein at least one of the calendar rolls is driveable by a friction wheel which is rotatably journalled on the rotary plate and runs around a fixed ring surface of the head part, characterized in that the imaginary axis about which the friction wheel turns is arranged fixed in space relative to the rotary plate and the friction wheel has a conical surface which rolls off on a complementary conical ring surface of a window ring; and in that the friction wheel can be adjusted or biased in the direction of the imaginary axis into engagement with the window ring and drives the calender roller associated with the friction wheel directly or via a shaft representing the rotational axle of the calendar roller, optionally via a conical wheel arranged between the friction wheel and the shaft or between the friction wheel and the calender roller; one of said calender rollers being a depositing roller which simultaneously deposits the fiber band directly onto the layers of fiber band already present in the can.

2. Can filling apparatus in accordance with claim 1, wherein the largest radius of the conical surface of the friction wheel is arranged further removed from the axis of rotation of the rotary plate than the smallest radius of this surface, i.e., when arranging a window ring above the rotary plate or the friction wheel the conical surface of the window ring diverges upwardly, wherein, when using a conical wheel the surface of the conical wheel complementary to the friction wheel converges in the opposite direction to the conical surface of the friction wheel.

3. Can filling apparatus in accordance with claim 1, wherein said calender roller turns about an axis arranged in a radial plane relative to the axis of rotation of the rotary plate and itself has a conical jacket surface, with the tip of this conical jacket surface lying on or in the immediate vicinity of the rotary axis of the rotary plate.

4. Can filling apparatus in accordance with claim 1, including a motor which brings about the rotary movement of said can and a rotary drive for the rotary plate comprising a drive system which engages around a ring wall of the rotary plate.

5. Can filling apparatus comprising a head part which is arranged in operation above a rotatable can and a rotary plate driveable to execute a rotational movement, with the rotary plate depositing a fiber band in continuous cycloidal loops into the can by means of two calender rolls which are journalled on the rotary plate via at least substantially horizontal axes, wherein at least one of the calender rolls is driveable by a friction wheel which is rotatably journalled on the rotary plate and runs around a fixed ring surface of the head part, characterized in that the imaginary axis about which the friction wheel turns is arranged fixed in space relative to the rotary plate and the friction wheel has a conical surface which rolls off on a complementary conical ring surface of a window ring; and in that the friction wheel can be adjusted or biased in the direction of the imaginary axis into engagement with the window ring and drives the calendar roller associated with the friction wheel directly or via a shaft representing the rotational axle of the calendar roller, optionally via a conical wheel arranged between the friction wheel and the shaft or between the friction wheel and the calender roller; said friction wheel having a cylindrical surface in addition to the conical surface, with the cylindrical surface standing in contact with the surface of the calender roller and directly driving the latter.

6. Can filling apparatus comprising a head part which is arranged in operation above a rotatable can and a rotary plate driveable to execute a rotational movement, with the rotary plate depositing a fiber band in continuous cycloidal loops into the can by means of two calender rolls which are journalled on the rotary plate via at least substantially horizontal axes, wherein at least one of the calender rolls is driveable by a friction wheel which is rotatably journalled on the rotary plate and runs around a fixed ring surface of the head part, characterized in that the imaginary axis about which the friction wheel turns is arranged fixed in space relative to the rotary plate and the friction wheel has a conical surface which rolls off on a complementary conical ring surface of a window ring; and in that the friction wheel can be adjusted or biased in the direction of the imaginary axis into engagement with the window ring and drives the calender roller associated with the friction wheel directly or via a shaft representing the rotational axle of the calender roller, optionally via a conical wheel arranged between the friction wheel and the shaft or between the friction wheel and the calender roller; said conical surface of the friction wheel standing in contact with a cone wheel arranged at one end face of the calender roller.

7. Can filling apparatus comprising a head part which is arranged in operation above a rotatable can and a rotary plate driveable to execute a rotational movement, with the rotary plate depositing a fiber band in continuous cycloidal loops into the can by means of two calender rolls which are journalled on the rotary plate via at least substantially horizontal axes, wherein at least one of the calender rolls is driveable by a friction wheel which is rotatably journalled on the rotary plate and runs around a fixed ring surface of the head part, characterized in that the imaginary axis about which the friction wheel turns is arranged fixed in space relative to the rotary plate and the friction wheel has a conical surface which rolls off on a complementary conical ring surface of a window ring; and in that the friction wheel can be adjusted or biased in the direction of the imaginary axis into engagement with the window ring and drives the calender roller associated with the friction wheel directly or via a shaft representing the rotational axle of the calender roller, optionally via a conical wheel arranged between the friction wheel and the shaft or between the friction wheel and the calender roller; said conical surface of the friction wheel standing in driving engagement with a conical wheel which lies diametrically opposite to the calender roller and drives the latter via said shaft.

8. Can filling apparatus comprising a head part which is arranged in operation above a rotatable can and a rotary plate driveable to execute a rotational movement, with the rotary plate depositing a fiber band in continuous cycloidal loops into the can by means of two calender rolls which are journalled on the rotary plate via at least substantially horizontal axes, one of said calender rollers being a depositing roller which simultaneously deposits the fiber band directly onto the layers of fiber band already present in the can, wherein at least one of the calender rollers is driveable by a friction wheel which is rotatably journalled on the rotary plate and runs around a fixed ring surface of the head part; wherein the imaginary axis about which the friction wheel turns is arranged fixed in space relative to the rotary plate; and wherein the fixed ring surface is formed on a window ring which is biased in the direction of the rotary axis of the rotary plate and towards the friction wheel.

9. Can filling apparatus comprising a head part which is arranged in operation above a rotatable can and a rotary plate driveable to execute a rotational movement, with the rotary plate depositing a fiber band in continuous cycloidal loops into the can by means of two calender rolls which are journalled on the rotary plate via at least substantially horizontal axes, one of said calender rollers being a depositing roller which deposits the fiber band directly and immediately onto the layers of fiber band already present in the can, wherein at least one of the calender rollers is driveable by a friction wheel which is rotatably journalled on the rotary plate and runs around a fixed ring surface of the head part; wherein the imaginary axis about which the friction wheel turns is arranged fixed in space relative to the rotary plate; and wherein the fixed ring surface is formed on a window ring which is biased in the direction of the rotary axis of the rotary plate and towards the friction wheel, the bias of the window ring towards the friction wheel being achieved by means of spring elements which press against the surface of the window ring remote from the friction wheel and are braced against the head part.

10. Can filling apparatus comprising a head part which is arranged in operation above a rotatable can and a rotary plate driveable to execute a rotational movement, with the rotary plate depositing a fiber band in continuous cycloidal loops into the can by means of two calender rolls which are journalled on the rotary plate via at least substantially horizontal axes, wherein at least one of the calender rollers is driveable by a friction wheel which is rotatably journalled on the rotary plate and runs around a fixed ring surface of the head part; wherein the imaginary axis about which the friction wheel turns is arranged fixed in space relative to the rotary plate; and wherein the fixed ring surface is formed on a window ring which is biased in the direction of the rotary axis of the rotary plate and towards the friction wheel; said window ring being supported with play in the direction radial to the axis of rotation of the rotary plate.

11. Can filling apparatus comprising a head part which is arranged in operation above a rotatable can and a rotary plate driveable to execute a rotational movement, with the rotary plate depositing a fiber band in continuous cycloidal loops into the can by means of two calender rolls which are journalled on the rotary plate via at least substantially horizontal axes, wherein at least one of the calender rolls is driveable by a friction wheel which is rotatably journalled on the rotary plate and runs around a fixed ring surface of the head part, characterized in that the imaginary axis about which the friction wheel turns is arranged fixed in space relative to the rotary plate and the friction wheel has a conical surface which rolls off on a complementary conical ring surface of a window ring; and in that the friction wheel can be adjusted or biased in the direction of the imaginary axis into engagement with the window ring and drives the calender roller associated with the friction wheel directly or via a shaft representing the rotational axle of the calender roller, optionally via a conical wheel arranged between the friction wheel and the shaft or between the friction wheel and the calender roller; one of said calender rollers being a depositing roller which deposits the fiber band directly and immediately onto the layers of fiber band already present in the can, the second calender roller also being driven from the friction wheel through drive means which brings about a reversal of the direction of rotation, so that the second calender roller turns in the opposite direction to the first calender roller.

12. Can filling apparatus in accordance with claim 11, wherein when driving the first named calender roller by the friction wheel via a cone wheel the cone wheel stands in driving engagement with a further cone wheel secured to the rotary axle for the second calender roller.

13. Can filling apparatus comprising a head part which is arranged in operation above a rotatable can and a rotary plate driveable to execute a rotational movement, with the rotary plate depositing a fiber band in continuous cycloidal loops into the can by means of two calender rolls which are journalled on the rotary plate via at least substantially horizontal axes, wherein at least one of the calender rolls is driveable by a friction wheel which is rotatably journalled on the rotary plate and runs around a fixed ring surface of the head part, characterized in that the imaginary axis about which the friction wheel turns is arranged fixed in space relative to the rotary plate and the friction wheel has a conical surface which rolls off on a complementary conical ring surface of a window ring; and in that the friction wheel can be adjusted or biased in the direction of the imaginary axis into engagement with the window ring and drives the calender roller associated with the friction wheel directly or via a shaft representing the rotational axle of the calender roller, optionally via a conical wheel arranged between the friction wheel and the shaft or between the friction wheel and the calender roller; wherein said calender roller turns about an axis arranged in a radial plane relative to the axis of rotation of the rotary plate and itself has a conical jacket surface, with the tip of this conical jacket surface lying on or in the immediate vicinity of the rotary axis of the rotary plate; and wherein the second calender roller has the same shape as the first named calender roller but is however oppositely directed to the latter.

14. Can filling apparatus comprising a head part which is arranged in operation above a rotatable can and a rotary plate driveable to execute a rotational movement, with the rotary plate depositing a fiber band in continuous cycloidal loops into the can by means of two calender rolls which are journalled on the rotary plate via at least substantially horizontal axes, wherein at least one of the calender rolls is driveable by a friction wheel which is rotatably journalled on the rotary plate and runs around a fixed ring surface of the head part, characterized in that the imaginary axis about which the friction wheel turns is arranged fixed in space relative to the rotary plate and the friction wheel has a conical surface which rolls off on a complementary conical ring surface of a window ring; and in that the friction wheel can be adjusted or biased in the direction of the imaginary axis into engagement with the window ring and drives the calender roller associated with the friction wheel directly or via a shaft representing the rotational axle of the calender roller, optionally via a conical wheel arranged between the friction wheel and the shaft or between the friction wheel and the calender roller; one of said calender rollers being a depositing roller which deposits the fiber band directly and immediately onto the layers of fiber band already present in the can; and a primary fiber band guide for guiding the fiber band along the axis of rotation of the rotary plate towards the calender roller pair; wherein the depositing roller projects further into the can than the lower side of the rotary plate and optionally projects further into the can than the lower side of a depositing plate provided on and rotating with the rotary plate.

15. Apparatus in accordance with claim 14, wherein the deposition plate is formed as a fiber scraper for the deposition roller.

16. Can filling apparatus comprising a head part which is arranged in operation above a rotatable can and a rotary plate driveable to execute a rotational movement, with the rotary plate depositing a fiber band in continuous cycloidal loops into the can by means of two calender rolls which are journalled on the rotary plate via at least substantially horizontal axes, wherein at least one of the calender rolls is driveable by a friction wheel which is rotatably journalled on the rotary plate and runs around a fixed ring surface of the head part, characterized in that the imaginary axis about which the friction wheel turns is arranged fixed in space relative to the rotary plate and the friction wheel has a conical surface which rolls off on a complementary conical ring surface of a window ring; and in that the friction wheel can be adjusted or biased in the direction of the imaginary axis into engagement with the window ring and drives the calender roller associated with the friction wheel directly or via a shaft representing the rotational axle of the calender roller, optionally via a conical wheel arranged between the friction wheel and the shaft or between the friction wheel and the calender roller, one of said calender rollers being a depositing roller which deposits the fiber band directly and immediately onto the layers of fiber band already present in the can, a conical guide member is provided immediately above the calender roller pair and rotates therewith about the axis of rotation of the rotary plate; and a conical guide member immediately above the calender roller pair and rotating therewith about the axis of rotation of the rotary plate.

17. Can filling apparatus comprising a head part which is arranged in operation above a rotatable can and a rotary plate driveable to execute a rotational movement, with the rotary plate depositing a fiber band in continuous cycloidal loops into the can by means of two calender rolls which are journalled on the rotary plate via at least substantially horizontal axes, wherein at least one of the calender rolls is driveable by a friction wheel which is rotatably journalled on the rotary plate and runs around a fixed ring surface of the head part, characterized in that the imaginary axis about which the friction wheel turns is arranged fixed in space relative to the rotary plate and the friction wheel has a conical surface which rolls off on a complementary conical ring surface of a window ring; and in that the friction wheel can be adjusted or biased in the direction of the imaginary axis into engagement with the window ring and drives the calender roller associated with the friction wheel directly or via a shaft representing the rotational axle of the calender roller, optionally via a conical wheel arranged between the friction wheel and the shaft or between the friction wheel and the calender roller, one of said calender rollers being a depositing roller which deposits the fiber band directly and immediately onto the layers of fiber band already present in the can; wherein the deposition roller is formed as a cylindrical, concave or grooved roller, in the latter case with the grooves extending in the axial direction along the surface of the roller.

* * * * *